United States Patent [19]

Goldstern

[11] Patent Number: 4,741,037

[45] Date of Patent: Apr. 26, 1988

[54] SYSTEM FOR THE TRANSMISSION OF SPEECH THROUGH A DISTURBED TRANSMISSION PATH

[75] Inventor: Ernest Goldstern, Hilversum, Netherlands

[73] Assignee: U.S. Philips Corporation, New York, N.Y.

[21] Appl. No.: 921,862

[22] Filed: Oct. 20, 1986

Related U.S. Application Data

[63] Continuation of Ser. No. 502,799, Jun. 9, 1983, abandoned.

[30] Foreign Application Priority Data

Jun. 9, 1982 [NL] Netherlands ..... 8202318

[51] Int. Cl.[4] ..... G10L 5/00

[52] U.S. Cl. ..... 381/47; 381/31; 381/35; 381/36

[58] Field of Search ..... 381/29–52; 364/513, 513.5, 717; 371/32, 36, 69; 455/54

[56] References Cited

U.S. PATENT DOCUMENTS 3,772,649 11/1973 Haselwood et al. ..... 371/69
4,291,405 9/1981 Jayant et al. ..... 371/31

FOREIGN PATENT DOCUMENTS 0041195 12/1981 European Pat. Off. .
2041601 9/1980 United Kingdom .

*Primary Examiner*—Emanuel S. Kemeny
*Attorney, Agent, or Firm*—David R. Treacy

[57] ABSTRACT

When a communication channel is noisy, speech signals at the transmitter are converted by a speech recognition unit to data-reduced code words which are then transmitted repeatedly as redundant data so as to fill the available bandwidth. At the receiver, the redundant signals are converted to drive a speech generator.

9 Claims, 1 Drawing Sheet

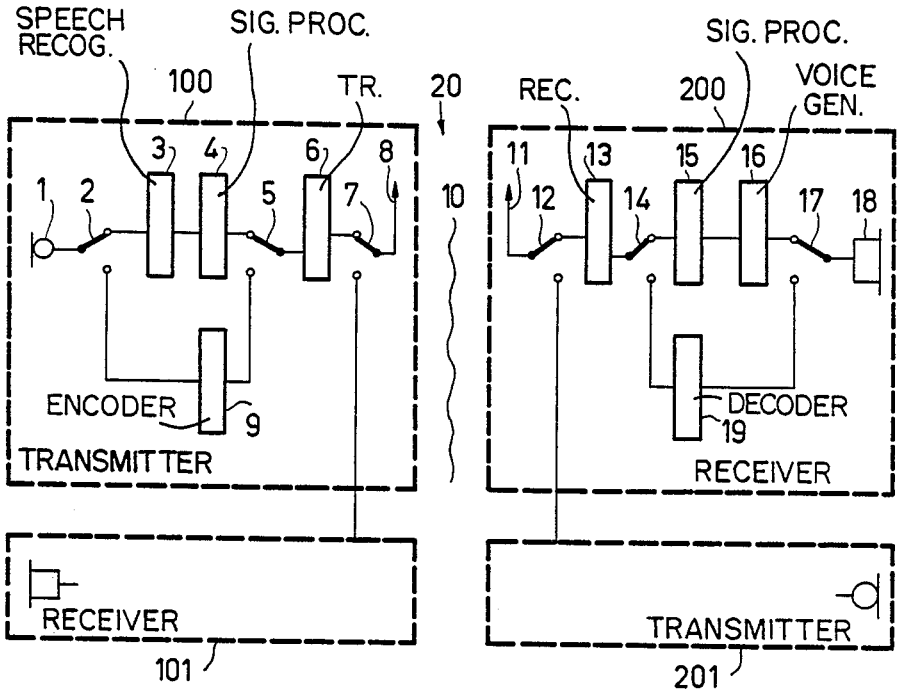
SPEECH RECOG.
SIG. PROC.
100
TR.
20
REC.
200
SIG. PROC.
VOICE GEN.
1
2
3
4
5
6
7
8
9
10
11
12
13
14
15
16
17
18
19
ENCODER
TRANSMITTER
DECODER
RECEIVER
RECEIVER
101
TRANSMITTER
201

SYSTEM FOR THE TRANSMISSION OF SPEECH THROUGH A DISTURBED TRANSMISSION PATH

This is a continuation of application Ser. No. 502,799 filed June 9, 1983, now abandoned.

BACKGROUND OF THE INVENTION (1) Field of the Invention.

The invention relates to a system for the transmission of speech through a transmission path which is susceptible to interference, comprising a transmitter and a receiver which are coupled to the transmission path, the transmitter comprising means for converting the speech into an analog electric signal and the receiver comprising means for converting a derived analog electric signal into derived speech.

(2) Description of the Prior Art.

Mobile speech communication networks are confronted in certain circumstances by (possibly intentionally produced) serious interference in a (possibly varying) portion of the radio medium used, which seriously hampers the connections or renders them even completely unfit for use.

Methods are known for avoiding such interferences, the frequency of the radio channel used being changed in accordance with a predetermined schedule in such a way that all the available frequencies are cyclically passed through in a synchronous manner, for example in accordance with a (long) pseudo-random sequence (what is commonly referred to as frequency hopping).

A disadvantage is that generally the disturbed frequencies are also part of the "hopping schedule", so that the received speech signal continues to be disturbed its intelligibility is greatly reduced. The signal may also be disturbed due to, for example, a (temporary) loss of the hopping synchronism or because of the fact that a noise signal "follows" the hopping schedule.

A different method of trying to maintain the connection is, for example, the suppression at the receiving side of the noise signal ("null-steering") by means of a suitable antenna configuration and an associated signal processing system. However, the iterative process which must then be used requires additional time. The desired result is usually not attained because of an adverse signal-to-noise ratio or an interference coming from several directions.

SUMMARY OF THE INVENTION

It is an object of the invention to provide a system which renders it possible to transmit speech signals through a seriously disturbed medium without the above-mentioned disadvantages occurring.

A solution to the problem of seriously disturbed speech transmission is seen in the conversion of speech into data at the transmitting side and from data into speech at the receiving side, starting from the (assumed) limitation of the relevant vocabulary. Methods of reducing nose effects can then be used with great effect.

It is furthermore assumed that the intelligibility is the primary requirement and that voice fidelity is not a requirement.

According to the invention, the system is characterized in that the transmitter comprises a speech recognizing arrangement for recognizing in response to the analog electric signal, words or word groups in the speech which are part of a predetermined, limited vocabulary, and for converting the recognized words or word groups into digital data words in accordance with a predetermined code. The transmitter also includes means for adding redundant information to the data words, the data words being transmitted together with the redundant information to the receiver. The receiver comprises means for recovering the original data words and a speech generating arrangement for converting these data words into a derived analogue electric signal.

The object of the invention is, in principle, accomplished by applying an error-correcting procedure to the digital data transmission thus obtained, the error-correcting capability generally proportional to the extent to which the medium may be disturbed.

In consideration of the fact that error correction usually requires a digital signal and that the error-correcting capability must be great to ensure a correct transmission, the inventive idea is implemented by having the spoken words or word groups converted by a speech recognizing circuit into predetermined data words, for example a (binary coded) number out of a sequence of numbers. The data words are each accompanied by as many redundancy bits (for example by means of word repetition) as is possible in connection with the ratio between the standard bit frequency (for example 16 kbit/s) used and the bit frequency (for example 16 bit/s) required for a word (word group)-coding from a vocabulary of, for example, 500 words or word groups. For the numbers given above, by way of example, this ratio is thus a factor 1000 or 30 dB. Thus, the data words are converted to a data stream having a multiplicity of repeated data words.

After demodulation, this creates at the receiving side the possibility to recover correctly, in spite of serious interference, the original data words resulting from the conversion at the transmitting side (for example by means of a simple majority decision), with a very high degree of reliability. They can be reproduced thereafter as regenerated speech by means of a speech synthesizing circuit which is programmed in agreement with the predetermined data/speech conversion protocol.

The gain obtained in the signal-to-noise ratio may alternatively be employed in a different way, for example by reducing the required bandwidth. The addition of ARQ (automotive repeat request) procedures is alternatively possible.

Taking account of the above-mentioned limitations, the system will be proof against a noise level which is some orders of magnitude larger than would be the case in the transmission of the, for example, the digitally encoded speech itself.

Before they are converted into speech the data words received lend themselves well for display on a screen, optionally as a "running text".

A conversion which, as regards redundancy reduction, is more modest, such as is used, for example, in voice-activated typewriters, produces coded text directly. In that case a bit rate of 100–200 bit/s must be reckoned with. The resulting more moderate gain in the signal-to-noise ratio is compensated by the convenient way in which this text can then be displayed in the receiver before conversion to speech, as a running text on a screen.

It should be noted that European Patent Application No. 0002435 discloses a system for telecontrol with voice commands, comprising system components for the processing of voice commands such as a microphone, a speech analyzer, an encoder, a transmitter, a receiver and adjusting elements.

In contrast therewith, the present invention relates to the transmission of speech through a disturbed transmission medium in which, at the receiving side, corresponding elements as mentioned above are indeed used; but in which, at the receiving side, speech is generated so that the human user of the system has a highly noise-insensitive speech connection at his disposal because of the large redundancy achievable with repeated word digital information transmission.

BRIEF DESCRIPTION OF THE DRAWING

The sole FIGURE shows the block diagram of an embodiment of a system in accordance with the invention.

DESCRIPTION OF THE PREFERRED EMBODIMENT

The transmission system in accordance with the invention comprises a transmitting unit 100 and a receiving unit 200, separated by the radio medium 10 which is subject to interference 20. In conjunction with the respective receiving unit 101 and transmitting unit 201 the customary interactive communication system with two transceivers is obtained.

The words or word groups spoken into microphone 1 of transmitting unit 100 apply through a mode change-over switch 2, an analog baseband signal, whose width may be limited to approximately 3 kHz, to a speech recognizing arrangement 3. The speech recognizing arrangement 3, which is known per se, converts this analog signal into consecutive data words which are associated in accordance with a predetermined protocol to the speech vocabulary consisting of words and/or word groups.

In signal processor 4 a logic processing operation of the received data words is effected which has for its object to provide protection against errors in the transmission path due to the assumed radio interferences, for example through a redundancy increase by means of repetition in corresponding to the bit frequency used. In addition, the processor may effect, if necessary, enciphering of the information, for example by using a number of pseudo-random sequences which are preselected each time for a predetermined period of time. The data signal thus processed is applied through a mode change-over switch 5 to a radio transmitter 6 and is radio-frequency modulated therein, for example by means of frequency modulation. The radio-frequency signal is applied through a transmit/receive change-over switch 7 to an antenna 8 which radiates the signal into the radio medium 10. In certain circumstances this transmission path is seriously disturbed by interference 20 at the frequencies used.

The disturbed radio-frequency signal entering at the antenna 11 of the receiving unit 200 is applied through a transmit/receive change-over switch 12 to a radio rreceiver 13 which, through a mode change-over switch 14, applies the data signal, after demodulation by the radio receiver, to a signal processor 15. Recovery of the original data words produced by the speech recognizing arrangement 3 in the transmitting unit 100 is effected in signal processor, for example by means of a majority decision from the systematically repeated information. On the basis of the data words thus obtained, the voice generating arrangement 16, which is known per se and in which the vocabulary used is stored, generates each time, in conformity with the conversion protocol, the associated words or word groups as an analog electric voice signal. This signal is thereafter made audible by means of a telephone receiver or loudspeaker 18 which is connected through a change-over switch 17.

In order to enable, in transmission conditions which allow this, for example because of the fact that the radio medium is temporarily disturbed to a lesser extent, a speech transmission which is not limited by a vocabulary and is possibly recognizable, the mode change-over switches 2 and 5 in the transmitting unit 100 mode change-over switches 14 and 17 in the receiving unit 200 are activated, for example by a suitable (voice) command, as a result of which the speech/data converters 3, 4 and 15, 16, respectively are replaced by a speech encoder 9 and a speech decoder 19, which together provide full vocabulary digital transmission and reception by, for example, a delta modulation system.

The change-over switches 7 and 12 are activated, for example manually, when a change is made from the transmitting position to the receiving position and vice versa at the transmitting/receiving combinations 100, 101 and 200, 201, respectively.

What is claimed is:

1. A system for the transmission of speech through a transmission path which is susceptible to interference, the system comprising a transmitter and a receiver coupled to the transmission path, the transmitter including means for converting received speech into corresponding analog electrical signals and the receiver including means for converting analog electrical signals into corresponding output speech, characterized in that:

said transmitter further includes:

(a) speech recognition means having a predetermined limited vocabulary of words or word groups and capable of response to analog electrical signals for recognizing said predetermined vocabulary words or word groups to produce corresponding vocabulary digital data words;

(b) means for supplying to said speech recognition means input analog electrical signals corresponding to received spoken speech words or word groups to thereby produce output digital words corresponding to recognized words or word groups;

(c) first signal processor means for receiving said output digital data words and, independent of any detection of impaired reception, for generating a data stream comprising a repetition for a predetermined number of times of each of said output digital data words, thereby adding redundant information thereto for error protection, said data stream having a bandwidth no greater than a bandwidth of digital signals corresponding to said analog electrical signals;

(d) transmission means connected to said signal processor means for transmitting said data stream to said receiver; and said receiver further includes:

(e) receiving means responsive to said transmitted digital data words and redundant information for producing a received signal;

(f) second signal processor means responsive to said received signal for recovering said output digital data words produced by said speech recognition means; and (g) speech-generating means having said predetermined vocabulary responsive to said recovered digital data words for converting said recovered digital data words into derived analog electrical signals corresponding to said input analog electrical signals.

2. A system as claimed in claim 1, characterized in that said second signal processor utilizes a majority decision of the received repeated words to accurately reproduce said output digital data words produced by said speech recognition means.

3. A system as claimed in claim 1, further characterized in that said first signal processor means enciphers said digital data words and redundant information through predetermined pseudo-random sequencing.

4. A transceiver comprising a transmitter unit and a receiver unit, said transmitter unit comprising means for converting received speech into corresponding analog electrical signals, transmission means for transmitting an information stream having a given bandwidth along a transmission path to a receiver, a speech/data converter including speech recognition means for accepting said signals and, responsive to said signals being representative of spoken words or word groups in a predetermined limited vocabulary, providing a redundant digital data words to said transmission means to form an information stream, having a bandwidth no greater than said given bandwidth, a speech signal processor for accepting said signals and, without vocabulary limitation, providing non-redundant electrical signals representative of said received speech to said transmission means to form said information stream having said given bandwidth, and transmitter mode change-over means for alternatively connecting said speech/data converter to said means for converting and to said transmission means, or connecting said speech signal processor to said means for converting and said transmission means; and said receiver unit comprising means for receiving an information stream transmitted along said transmission path, a data/speech converter connectable to said means for receiving for recovering said digital data words from said information stream, means, responsive to reception, by said means for receiving, of an information stream comprising non-redundant electrical signals representative of said received speech without vocabulary limitation, for producing analog electrical received signals, means for connecting to said means for producing, and for producing audible speech signals corresponding to said analog electrical received signals, and receiver mode change-over means for alternatively connecting said data/speech converter or said means for producing analog electrical received signals to said means for receiving.

5. A transceiver as claimed in claim 4, wherein said transmission path is a radio channel for two-way communication, comprising an antenna and a transmit/-receive switch for alternatively connecting said antenna to said transmission means or to said means for receiving, and said receiving unit comprises speech-generating means havaing said predetermined limited vocabulary, connectable to said means for receiving and responsive to the recovered digital data words for converting the recovered digital data words into derived analog electrical received signals corresponding to said input analog electrical signals.

6. A transceiver as claimed in claim 5, wherein said speech signal processor provides a delta modulated digital signal to said transmission means, and said receiver mode change-over means connects said means for producing audible speech signals alternatively to said speech-generating means or said means for producing analog electrical received signals.

7. A transceiver as claimed in claim 5, wherein said speech signal processor provides a digital signal to said transmission means, and said receiver mode change-over means comprises said means for connecting, and connects said means for producing audible speech signals alternatively to said speech-generating means or said means for producing analog electrical received signals.

8. A transceiver as claimed in claim 7, characterized in that said speech/data converter comprises speech recognition means having a predetermined vocabulary of words or word groups and capable of response to said analog electrical signals for recognizing said predetermined vocabulary words or word groups to produce corresponding output digital data words; and first signal processor means for receiving said output digital data words and, independent of any detection of impaired reception, for generating a data stream comprising a repetition for a predetermined multiplicity of times of each of said output digital data words, thereby adding redundant information thereto for error protection, and said data/speech converter recovers the transmitted digital data word by majority decision of the received repeated words.

9. A transceiver as claimed in claim 7, characterized in that said speech/data converter enciphers said digital data words through predetermined pseudo-random sequencing.

* * * * *